United States Patent [19]

Chappelle

[11] 4,379,043

[45] Apr. 5, 1983

[54] WATER-DECOMPOSITION AND GAS-GENERATING APPARATUS

[75] Inventor: Claude L. Chappelle, Seabrook, Tex.

[73] Assignees: Robert G. Francisco, Flint, Mich.; Loren V. Williams, Houston, Tex.; Dan Hennigan, Houston, Tex.; James R. Cornish, Houston, Tex.; Charles R. Allen, Houston, Tex.

[21] Appl. No.: 326,497

[22] Filed: Dec. 2, 1981

Related U.S. Application Data

[63] Continuation-in-part of Ser. No. 190,872, Sep. 25, 1980, abandoned.

[51] Int. Cl.[3] ..... C25B 11/03; C25B 11/12; C25B 9/00; C25B 15/02

[52] U.S. Cl. ..... 204/229; 204/270; 204/272; 204/284; 204/294; 204/278

[58] Field of Search ..... 204/272, 294, 284, 275–278, 204/269, 270, 229, 129

[56] References Cited

U.S. PATENT DOCUMENTS

| | | | |
|---|---|---|---|
| 1,440,091 | 12/1922 | Long | 204/272 |
| 2,468,766 | 5/1949 | Low | 204/272 X |
| 3,079,324 | 2/1963 | Allen et al. | 204/246 |
| 3,095,365 | 6/1963 | Green | 204/229 |
| 3,793,173 | 2/1974 | Kawahata | 204/272 X |
| 3,957,618 | 5/1976 | Spirig | 204/270 |
| 3,990,962 | 11/1976 | Götz | 204/272 X |
| 4,039,422 | 8/1977 | Packer | 204/272 |
| 4,040,938 | 8/1977 | Robertson | 204/272 X |
| 4,113,601 | 9/1978 | Spirig | 204/272 X |

FOREIGN PATENT DOCUMENTS 2810528 9/1978 Fed. Rep. of Germany .

*Primary Examiner*—Donald R. Valentine
*Attorney, Agent, or Firm*—Sandler & Greenblum

[57] ABSTRACT

An apparatus is provided for decomposing water and producing detonating gas by electrolysis. The apparatus includes a plurality of annular carbon electrodes which are concentrically arranged about a common vertical axis. The annular electrodes are perforated and have upper and lower ends, the lower ends being positioned adjacent to sealing and insulating elements in order to form a plurality of concentrically-arranged cells for containing electrolyte, e.g., water. A solid carbon electrode, preferably cylindrical, is positioned within the smallest concentric electrode and along the common axis. Apparatus is provided for supplying water to the cells, and for applying a direct current across the electrodes in order to evolve the detonating gas from the electrolyte in the cells by electrolysis.

17 Claims, 8 Drawing Figures

WATER-DECOMPOSITION AND GAS-GENERATING APPARATUS

CONTINUING APPLICATION

This application is a Continuation-in-Part of U.S. patent application Ser. No. 190,872, filed Sept. 25, 1980, now abandoned. The contents of such application are expressely incorporated by reference herein.

BACKGROUND OF THE INVENTION

1. Field of the Invention The present invention generally relates to a water-decomposition and gas-generating apparatus, and more particularly to a water-decomposition and gas-generating apparatus used to produce detonating gas or oxy-hydrogen gas in an efficient manner by the electrolysis of water.

2. Discussion of Prior Art

Prior art apparatus for producing detonating gas via the electrolysis of water are unsatisfactory for several reasons. They require too much electric current and amperage to produce a satisfactory amount of detonating gas in relation to the energy input required, and are thus inefficient for desired purposes, e.g., for use in running automobile engines or stationary power engines, such as energy plants for heating buildings, as well as for cooking. The following patents, cited during the prosecution of the above-referenced parent application, are examples of such unsatisfactory water-decomposition apparata.

Spirig, U.S. Pat. No. 4,113,601, discloses a water-decomposition apparatus for producing detonating gas or oxy-hydrogen gas; this decomposition apparatus includes a plurality of electrolytic cells formed between a nested plurality of endless laminar electrodes. Electrolyte circulates through the assembly, and current is applied to the inner and outer electrodes from a DC source. When the electrode assembly is to be immersed in electrolyte, the outermost electrode is placed within an electrically inoperative shielding member.

Spirig, U.S. Pat. No. 3,957,618, discloses a water-decomposition apparatus for producing detonating gas or oxy-hydrogen gas; the apparatus includes a plurality of adjacent electrolysis cells. The cells are positioned within a common compartment, and are constructed as open vessels, each cell opening into the most closely adjacent, lower-positioned cell. A gas outlet or discharge is provided for outwardly conducting gas which is produced by the apparatus.

Long, U.S. Pat. No. 1,440,091, discloses an electrode apparatus comprising a plurality of concentric electrodes formed of glass tubes filled with mercury, or from metal rods, e.g., copper covered with a thin platinum sleeve.

Gotz, U.S. Pat. No. 3,990,962, discloses an electrolytic cell device comprising a plurality of generally concentric tubular electrodes positioned within a generally cylindrical pressure vessel. Together, the electrodes and vessel form a plurality of serially-connected cells which are spaced from each other. By applying a DC voltage source across the electrodes, hydrogen and oxygen gas will be produced, and will be collected as a mixture in a collecting chamber located between the upper surface of the liquid electrolyte and the lid of the pressure vessel.

None of the above patents, however, discloses a combination water-decomposition and gas-generating apparatus which has a plurality of carbon, annular, spaced-apart, and perforated concentric electrodes which are positioned about a central, solid carbon electrode.

SUMMARY OF THE INVENTION

Accordingly, it is a general object of the present invention to provide a new and improved water-decomposition and gas-generating apparatus which is more efficient, and which can utilize lower voltage and amperage to produce a predetermined volume of detonating gas than known gas-generating apparata.

It is an additional object of the present invention to provide a new and improved water-decomposition and gas-generating apparatus which can generate detonating gas at a quicker rate than prior gas-generating apparatus, and which can simply and rapidly produce such detonating gas.

Yet another object of the present invention is to provide a new and improved water-decomposition and gas-generating apparatus which has enhanced conductivity due to the carbon material which comprises the electrodes, and which speeds the reaction as a result.

Still another object of the present invention is to provide a new and improved water-decomposition and gas-generating apparatus which produces detonating gas more efficiently than previous devices as a result of increased electrode surface area; this increase is achieved by providing the electrodes with perforations.

Still another object of the present invention is to provide a new and improved water-decomposition and gas-generating apparatus which is capable of detecting the level of water within the apparatus, and which is capable of regulating the level of water in the apparatus in response to the level detected.

Yet a further object of the present invention is to provide a new and improved water-decomposition and gas-generating apparatus which can be immersed in an electrolyte, e.g., water, or which can be provided with an enclosed water circulatory system for delivering liquid electrolyte.

Briefly, the above and other objects, features, and advantages of the present invention are attained in one aspect thereof by providing an apparatus for decomposing water and producing detonating gas which includes a plurality of annular carbon electrodes, concentrically arranged about a common vertical axis, each of the annular electrodes having an upper end and a lower end. Each annular electrode also has a plurality of perforations located along its surface. A central, solid carbon electrode is positioned coextensively along the common vertical axis. Sealing and insulating elements are positioned adjacent to the lower electrode ends to form, with the annular electrodes and central electrode, a plurality of concentrically-arranged cells. Means for supplying liquid electrolyte to the cells, and means for applying a DC current across the electrodes are also provided in order to evolve detonating gas from the cells.

BRIEF DESCRIPTION OF THE DRAWINGS

The above and other objects, features, and advantages of the present invention will become more fully apparent to those of ordinary skill in the art to which this invention pertains from the following detailed description, when considered in connection with the accompanying drawings, in which like reference characters designate like or corresponding parts throughout the several views, and wherein.

DETAILED DESCRIPTION OF THE DRAWINGS

Figure 1:
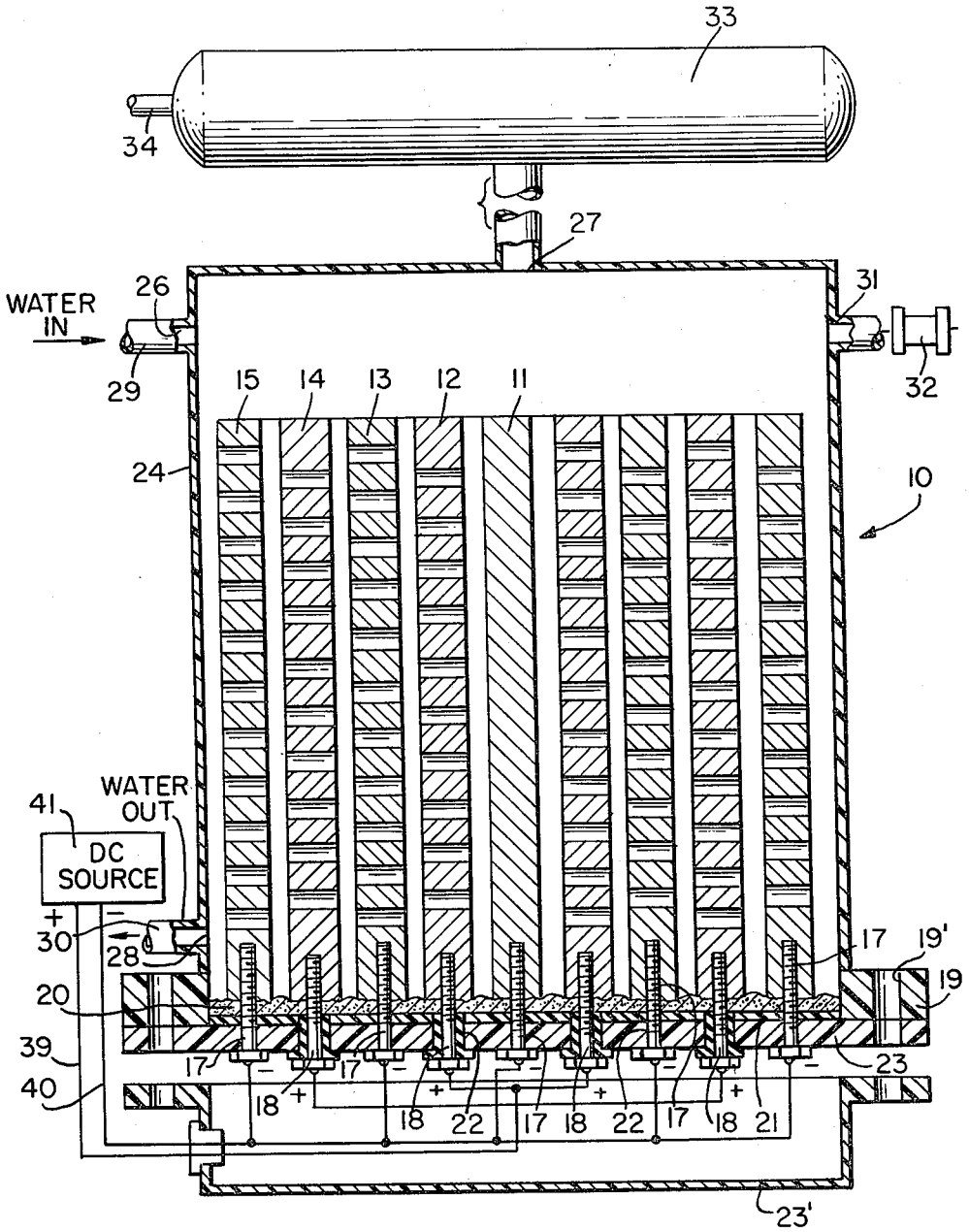
FIG. 1 is a sectional view of a water-decomposition and gas-generating apparatus formed in accordance with the present invention.
Figure 3:
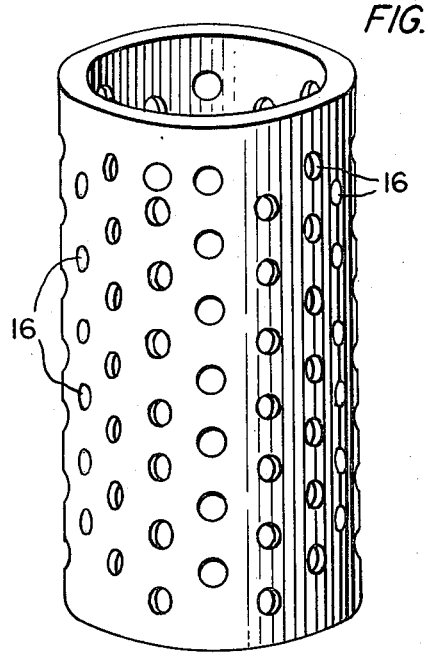
FIG. 3 is a perspective view of one of the annular, perforated concentric electrodes forming a portion of the apparatus of FIG. 1.

Referring more specifically to the drawings, FIG. 1 illustrates the overall construction of a water-decomposition and detonating gas-generating apparatus 10. The apparatus includes a central, generally cylindrical solid carbon electrode 11. Surrounding the solid electrode, in spaced relation, are a plurality of annular electrodes 12, 13, 14, and 15. A representative annular and hollow electrode is best illustrated in FIG. 3, and includes a plurality of perforations 16 extending over its entire height and along its entire peripheral surface area; this increases the surface area which will contact liquid electrolyte in the apparatus, and thus increases the efficiency of the apparatus in producing detonating gas. The central electrode 11 and annular electrodes 13 and 15, as shown, are negative electrodes; electrodes 12 and 14 are shown as being positive. As seen in FIG. 1, each electrode has an upper and lower end; the lower ends of the electrodes are attached to connector bolts 17, for the negative electrodes, and brass connector bolt 18, for the positive electrodes. The bottom portions of the electrodes extend through bottom plate 23 having flange 19, epoxy sealing layer 20, and dielectric plate 21. Flange 19 includes a plurality of apertures 22, through which brass connector bolts 17 and 18 can extend. The flange 19 of plate 23 can be connected to a bottom plate 23', as best seen in FIG. 1. An electrically non-conductive shielding member or shell 24 surrounds and encloses the entire assembly.

Figure 4:
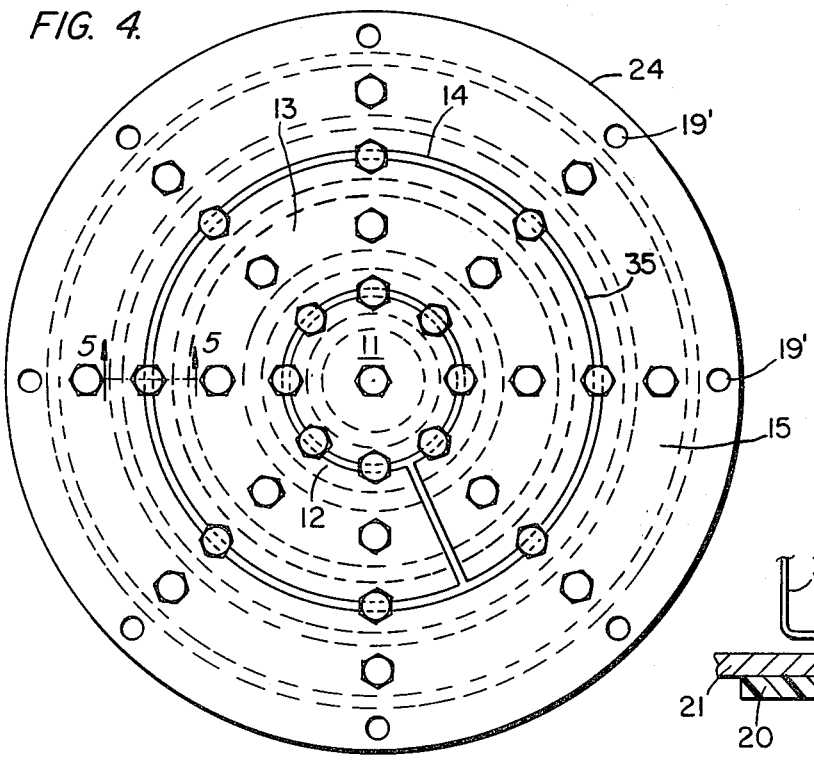
FIG. 4 is a bottom plan view of the apparatus of FIG. 1.

Connecting bolts 17 for the negative electrodes are circumferentially disposed about the apparatus, as best seen in FIG. 4. Connector bolts 18 are also circumferentially attached to electrodes 12 and 14.

Closure plate 23' is attached to shell 24 via flange 19 and by bolt holes 19', which are adapted to receive bolts or similar, conventional attaching elements (not shown) for securing the assembly.

The top edges of electrodes 12–15 are open and are unattached, the annular spaces located between each pair of adjacent electrodes 11–15 serving as cells, through which water or other liquid electrolyte passes via perforations 16. Water enters the shell and apparatus via water inlet aperture 26. The top of the shell or container is provided with a detonating-gas outlet aperture 27, and the side of the container is provided with a water outlet aperture 28. The inlet and outlet water apertures 26 and 28, respectively, can be attached to inlet and outlet conduits 29 and 30, respectively.

The container is also advantageously provided with a water-level control aperture 31, through which a water-level probe or detector 32 is attached for sensing the level of water within container or shell 24 and for controlling the operation of water supply means, e.g., a pump, to the container.

A condensation tank 33 can be provided for collecting detonating gas escaping the apparatus via gas outlet aperture 27, and tank 33 can itself be provided with a second, detonating-gas outlet aperture 34 for allowing detonating gas to escape the gas-generating apparatus and enter a larger system at a desired location. Any suitable conduit can be connected to second gas outlet aperture 34.

Figure 2:
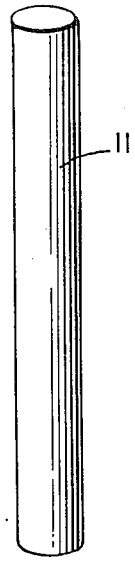
FIG. 2 is a perspective view of the solid central electrode forming a portion of the apparatus of FIG. 1.

The carbon electrodes of the present invention are best illustrated in FIGS. 2 and 3. FIG. 2 shows solid-carbon central electrode 11, shown as having a generally cylindrical shape, and FIG. 3 illustrates one of the annular carbon electrodes 12–15. By providing perforations 16 along the surface of each annular carbon electrode, the surface area of each carbon electrode is increased by approximately 25.2% in comparison to the surface area of a similarly-dimensioned annular electrode lacking perforations; this increase in surface area of each electrode adapted to contact liquid electrolyte in the apparatus enhances the production of detonating gas when equal amounts of electricity and electrolyte, e.g., water, are utilized. As is evident from FIGS. 1, 4, and 7, the concentric annular electrodes are provided with an increasing diameter, as seen in a direction taken from the interior of the apparatus towards the exterior; in other words, it is readily apparent that each successive electrode must have a larger diameter than the electrode adjacent to it which is located closer to the central vertical axis of the apparatus.

Figure 5:
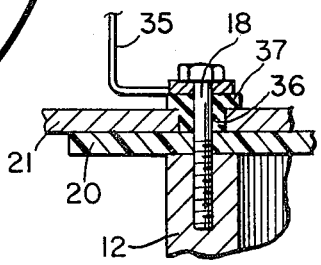
FIG. 5 is a sectional view of one positive electrode assembly of the apparatus of FIG. 1.

FIG. 4 is a bottom plan view of the apparatus, and better illustrates the electric connection of the electrodes. A copper connector ring 35 is attached to the bottom of electrodes 12 and 14 by a brass washer 36. This connection is best illustrated in FIG. 5, in which the copper connector ring is shown attached to the bottom of one anode by brass connector bolt 18, which extends through the bottom plate 23, insulating sleeve/-feed-through insulator 37, the brass washer, dielectric plate 21, epoxy layer 20, and into the bottom of the electrode. The insulator and washer serve to completely isolate positively-charged brass bolt 18 from dielectric plate 21 and outer container or shell 24.

The bottom portion of each electrode 12–15 is provided with a plurality, e.g., eight, circumferential holes which are adapted to receive a plurality of brass connector bolts, 17 or 18, respectively. Solid carbon electrode 11 includes only one central bolt hole, as seen in FIG. 5, for attachment to the copper ring.

Figure 6:
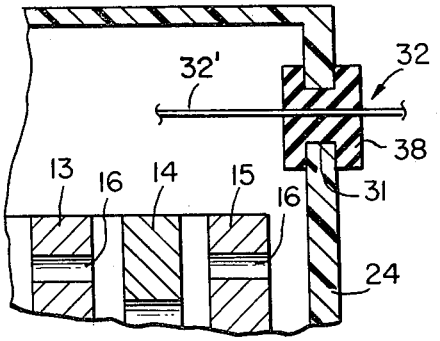
FIG. 6 is a sectional view of a water-level sensor forming a portion of the apparatus of FIG. 1.

Water enters the system via water inlet aperture 26, as shown in FIG. 1, and initially displaces air outwardly through detonating-gas aperture 27. When water or other liquid electrolyte attains a predetermined level within the apparatus, water-level probe 32, best illustrated in FIG. 6, positioned within water-level control aperture 31, detects the presence of water, and communicates with a water supply pump (not shown) to cease its operation. As shown in FIG. 6, the level detector includes a probe 32', and is fit within aperture 31 by a neoprene bushing and seal 38.

As seen in FIG. 1, electrical connections to the electrodes are provided by positive and negative leads 39 and 40, respectively. The connections enter through bottom plate 23 via feed-through insulators 37, and are taken to a suitable direct-current source 41 having positive and negative terminals. The source can take any conventional form, e.g., a battery, generator, or a rectifier energized by an alternating-current source.

In operation, voltage is applied to the assembly by direct-current source 41, and current flows between the electrodes via the liquid electrolyte in the assembly. Electrolysis of the electrolyte, e.g., water, then occurs, and gas is produced along the surface of all of the electrodes, including the surfaces of all of the perforations of each electrode. Detonating gas thus collects above the electrolyte level within shell 24, and passes outwardly from the apparatus through aperture 27. As detonating gas is formed, the level of liquid declines, and probe 32 indicates to the water supply pump (not shown) to again supply water to the apparatus so that it will again attain an optimal level for efficient gas production.

Probe 32 carries no voltage, but controls the level of water by virtue of impedance via a processor (not shown) located away from the apparatus.

Figure 7:
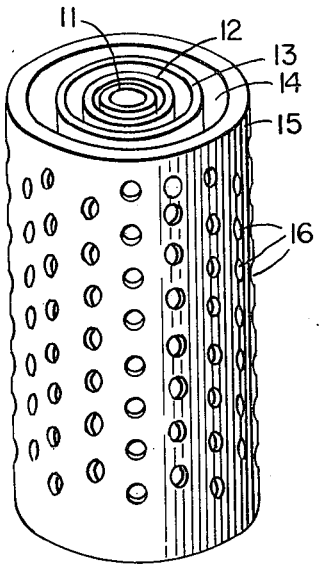
FIG. 7 is a perspective view of the assembled concentric electrodes which form a portion of the apparatus of FIG. 1.

Although five electrodes are illustrated, as shown in FIG. 7, when arranged concentrically, it is apparent that any number of electrodes could equally well be utilized. The current applied to the electrodes via direct-current source 41 needs to be adjusted as the number of electrodes increases in order to maintain optimal production of detonating gas. As indicated above, water or other liquid electrolyte is supplied to the system when necessary in an amount related to the volume of gas generated by the system.

The apparatus can be provided with an enclosed water circulatory system, or can be immersed in a larger water vessel in order to provide a suitable supply of liquid electrolyte.

Figure 8:
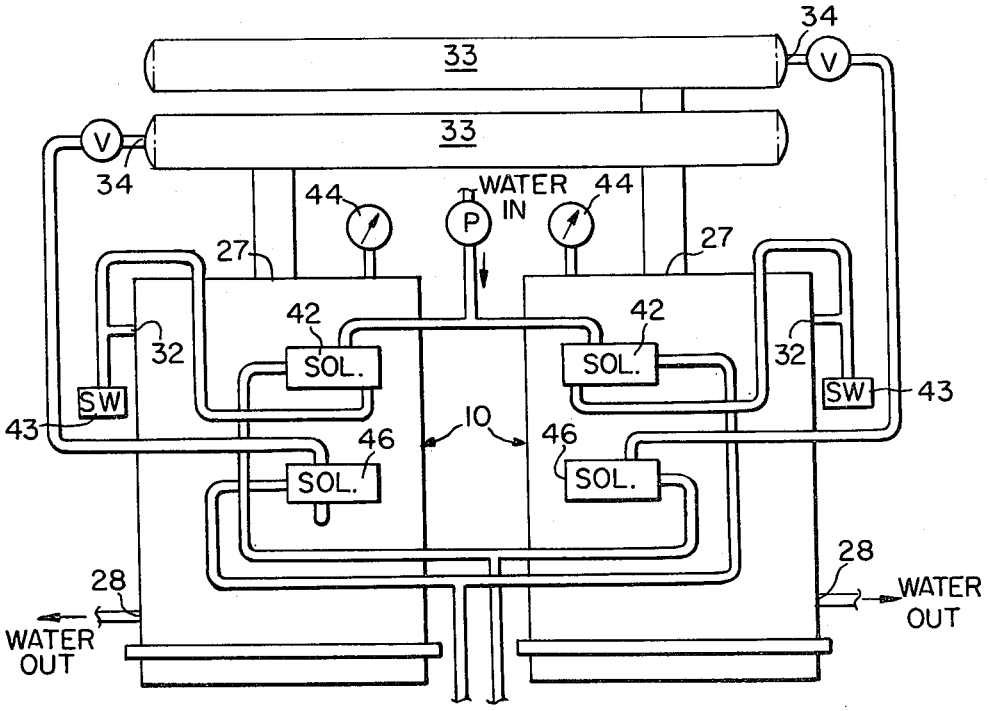
FIG. 8 is a schematic view of a system incorporating the apparatus of FIG. 1.

FIG. 8 is a schematic view of a system utilizing the present apparatus. As shown, the system includes two cells, each of which is provided with a water inlet solenoid 42 for controlling electrolyte supply; when an optimal level of water is reached within the cells, water-level probes 32 instruct the solenoids to temporarily terminate water flow from respective pumps. When current is supplied to the cells, detonating gas is generated by the electrolytic process, and passes outwardly from each apparatus via detonating-gas outlet aperture 27 into a respective condensation/gas-collecting tank 33. As the pressure exerted by the gas increases, the current supplied can be decreased by virtue of electric pressure switches 43. These switches are controlled in accordance with the measurements taken by pressure gauges 44 located in the upper portion of each cell. Detonating gas moves from condensation tanks 33 through tubing, e.g., copper, via and to detonating-gas outlet solenoids 46; the gas is then preferably conducted to low-pressure storage tanks (not shown).

The water outlet apertures 28 can be provided with a valve for optional back-washing or emptying of the apparatus.

As one example of the apparatus, the cell 10 comprises a plurality of hollow, annular carbon cylinders, each having one-half-inch-thick walls, each six inches long (high), and each being concentrically separated from adjacent cylinders by one-eighth of an inch. The diameter of the outermost carbon cylinder is six inches. In this arrangement, the outermost cylinder has a positive polarity, the next adjacent inner cylinder has a negative polarity, the next one positive, and the fourth one negative. The innermost, solid cylinder comprises a one-inch diameter core of positive polarity. This apparatus is provided to extract hydrogen from water at a relatively low voltage of 12 volts DC. This voltage is applied to the carbon cylinders, which begin electrolysis of the water to convert it to oxygen and hydrogen (detonating) gas. This voltage is applied to the cell at 80 amps, and detonating gas is thus released and adapted to be piped to a storage tank, from where it can be conducted to any unit or system which can utilize such gas. A pump can be provided to dispose of waste material.

From the foregoing description, one skilled in the art can easily ascertain the essential characteristics of this invention, and, without departing from the spirit and scope thereof, can make various changes and modifications of the invention to adapt it to various usages and conditions.

What is claimed is:

1. Apparatus for decomposing water and producing detonating gas comprising:

(a) a plurality of annular carbon electrodes concentrically arranged about a common vertical axis, said annular electrodes each having an upper end and a lower end, each annular electrode having a plurality of perforations along its surface;

(b) a central, solid carbon electrode positioned along said axis;

(c) sealing and insulating elements positioned adjacent said lower electrode ends to form, with the annular electrodes and central electrode, a plurality of concentrically-arranged cells which are adapted to hold liquid electrolyte;

(d) means for supplying liquid electrolyte to said cells; and (e) means for applying a direct current across said electrodes in order to evolve detonating gas from said cells.

2. Apparatus in accordance with claim 1 wherein said annular carbon electrodes comprise perforated concentric cylinders.

3. Apparatus in accordance with claim 2 wherein said cylinders are placed within an enclosure which comprises a hollow metal shell.

4. Apparatus in accordance with claim 3 wherein said hollow shell is concentrically arranged about said electrodes, said shell having an upper end and a lower end, said lower end of said shell being sealed by a dielectric plate, an epoxy layer, a bottom plate, and a closure plate.

5. Apparatus in accordance with claim 2 wherein each of said concentrically-arranged cells is bounded by a pair of adjacent electrodes and by said insulating and sealing elements, said insulating and sealing elements comprising a dielectric plate and a layer of epoxy.

6. Apparatus in accordance with claim 1 further comprising a shell for enclosing the electrode apparatus and which is adapted to contain a liquid electrolyte.

7. Apparatus in accordance with claim 6 further comprising a water inlet opening adapted to conduct a supply of water or other liquid electrolyte to said cells.

8. Apparatus in accordance with claim 1 wherein said electrodes are electrically connected in series by a copper ring, said apparatus being combined with a direct-current source connected across said electrodes.

9. Apparatus in accordance with claim 8 wherein said direct-current source comprises a battery.

10. Apparatus in accordance with claim 8 wherein said direct-current source comprises a generator.

11. Apparatus in accordance with claim 8 wherein said direct-current source comprises a rectifier energized by an alternating-current source.

12. Apparatus in accordance with claim 11 further comprising means for detecting the pressure of gas generated by the apparatus, and for reducing the current supply to the electrodes in accordance with the pressure detected.

13. Apparatus in accordance with claim 1 wherein each of said concentrically-arranged electrodes comprises a hollow tube or cylinder.

14. Apparatus in accordance with claim 1 further comprising a water-level detector for determining the level of water within said apparatus, said detector being positioned within a shell surrounding said electrodes, and further comprising means for controlling the operation of a water supply pump in accordance with the level of water detected.

15. Apparatus in accordance with claim 14 wherein said water-level detector comprises a probe and a neoprene seal.

16. Apparatus in accordance with claim 1 further comprising a conduit attached to a shell surrounding said electrodes, said conduit connected to a detonating-gas outlet aperture and adapted to conduct detonating gas from said shell to a condensation tank for storing said detonating gas.

17. Apparatus in accordance with claim 1 further comprising a shell surrounding said electrodes, said shell including a water aperture, a water outlet aperture, and a detonating-gas outlet aperture.

* * * * *